US005259616A

United States Patent [19]

Bergmann

[11] Patent Number: 5,259,616

[45] Date of Patent: Nov. 9, 1993

[54] ROULETTE-TYPE COIN-OPERATED GAMING MACHINE

[76] Inventor: Tjark Bergmann, Trummersweg 10, DE-2000 Hamburg 20, Fed. Rep. of Germany

[21] Appl. No.: 781,236

[22] PCT Filed: May 7, 1991

[86] PCT No.: PCT/EP91/00856

§ 371 Date: Feb. 28, 1992

§ 102(e) Date: Feb. 28, 1992

[87] PCT Pub. No.: WO91/17529

PCT Pub. Date: Nov. 14, 1991

[30] Foreign Application Priority Data

May 7, 1990 [DE] Fed. Rep. of Germany ..... 4014477

[51] Int. Cl.[5] ..... G07F 17/34

[52] U.S. Cl. ..... 273/138 A

[58] Field of Search ..... 273/138 A, 143 R

[56] References Cited

U.S. PATENT DOCUMENTS 4,573,681 3/1986 Okada ..... 273/143 R 4,991,848 2/1991 Greenwood et al. ..... 273/143 R

FOREIGN PATENT DOCUMENTS

WO82/01611 5/1982 PCT Int'l Appl. ..... 273/138 A

*Primary Examiner*—Benjamin H. Layno

*Attorney, Agent, or Firm*—Dominik, Stein, Saccocio, Reese, Colitz & van der Wall

[57] ABSTRACT

According to a process for operating a slot machine that works as a roulette wheel, the gambler determines the amount of the stake by introducing coins then by pressing selection keys. A microprocessor determines the result of the game by means of random algorithm. When the chosen number is hit, the microprocessor instructs the coin distributing unit to eject the main prize. When a chosen number is hit, the microprocessor drives another processor with a random generator. The random generator determines, depending on a written algorithm, a gain multiplier which is multiplied by the amount of the stake on the number that was hit. The payment unit is then instructed to distribute an amount in coins which corresponds to the product of the stake on the number that was hit and the gain multiplier.

5 Claims, 2 Drawing Sheets

ROULETTE-TYPE COIN-OPERATED GAMING MACHINE

BACKGROUND OF THE INVENTION

The invention relates to a process for operating a coin-operated gaming machine of the roulette type, with a roulette-like number pan and setting keyboard arranged on the front side of the coin-operated gaming machine, in which the player fixes the amount of the stake by the insertion of coins and subsequent key selection, and a microprocessor then determines the game result by means of a random algorithm and, when a set number has been hit, activates the coin output unit for the ejection of the main win, and to a coin-operated gaming machine for carrying out the process.

In known coin-operated gaming machines of the relevant generic type, numbers from 0 to 12 can be set by means of one or more coins. Depending on the set number range and on the player's selection, in the event of a win an amount of up to 12 times the winning number can be paid out. It has been shown, however, that a maximum obtainable win multiplier of 12 gives players, who are aware of the possibility of achieving jackpot wins from other coin-operated gaming machines, only a slight incentive to play.

SUMMARY OF THE INVENTION

The object of the invention is to improve the process, mentioned in the introduction, for operating a coin-operated gaming machine of the roulette type, in such a way that, depending on chance, there is the possibility of achieving a maximum jackpot-like win. The object of the invention is, furthermore, to design a coin-operated gaming machine so that it allows the process to be carried out.

According to the invention, the solution for achieving this object is obtained in terms of the process by means of the defining features of claim 1 and in terms of the coin-operated gaming machine as disclosed herein. Advantageous embodiments of the invention are described in the dependent claims.

According to the invention, the player has the possibility that, in the event of a hit of the set number, the random-number generator of the additional processor determines a win multiplier for the maximum win which is a multiple higher than in known coin-operated gaming machines. In coin-operated gaming machines designed according to the invention, the factors of the random win multiplier are graded, for example, in the following divisions: 10, 25, 50, 100, 1000 or 8, 12, 20, 100, 1000. The statistical average of payouts actually made likewise amounts to 12, that is to say, even when the additional random-number generator is used, the statistical average remains at the win multiplier of 12. However, the random-number generator of the additional processor is so designed that in 85% of all game situations, when a set number is hit, the random-number generator determines only the lower win multiplier. Thus, if 15 stakes are placed on one number, in this case the player receives only ten times or eight times his stakes and therefore less than in the known coin-operated gaming machines. In contrast, in 15% of all game situations, when a set number is hit the random-number generator of the additional processor determines a higher win multiplier, such as, for example, 25, 50, 100, 1000 or 12, 10, 100, 1000. Thus, with 15 stakes on the hit number, a jackpot-like main win of fifteen thousand stakes is possible. This appreciably increases the player's incentive to play. Because the additional processor is designed as a 33-bit processor with a random-number generator, as a result of the large number of approximately 4.2 billion basic numbers it is virtually impossible to determine a random combination producing a jackpot. This affords the machine operator a good safeguard against unauthorized persons obtaining a jackpot by manipulation.

A risk circuit can also be provided additionally or alternatively. By the actuation of a risk key, the player can then, for example, play by risking the jackpot and thereby has the possibility of achieving a kind of super-jackpot. It is advantageous, in this case, to display the "jackpot" status on the front face of the coin-operated gaming machine, so that the player still has the opportunity for a short time of commencing the risk game.

DETAILED DESCRIPTION OF THE INVENTION

Figure 1:
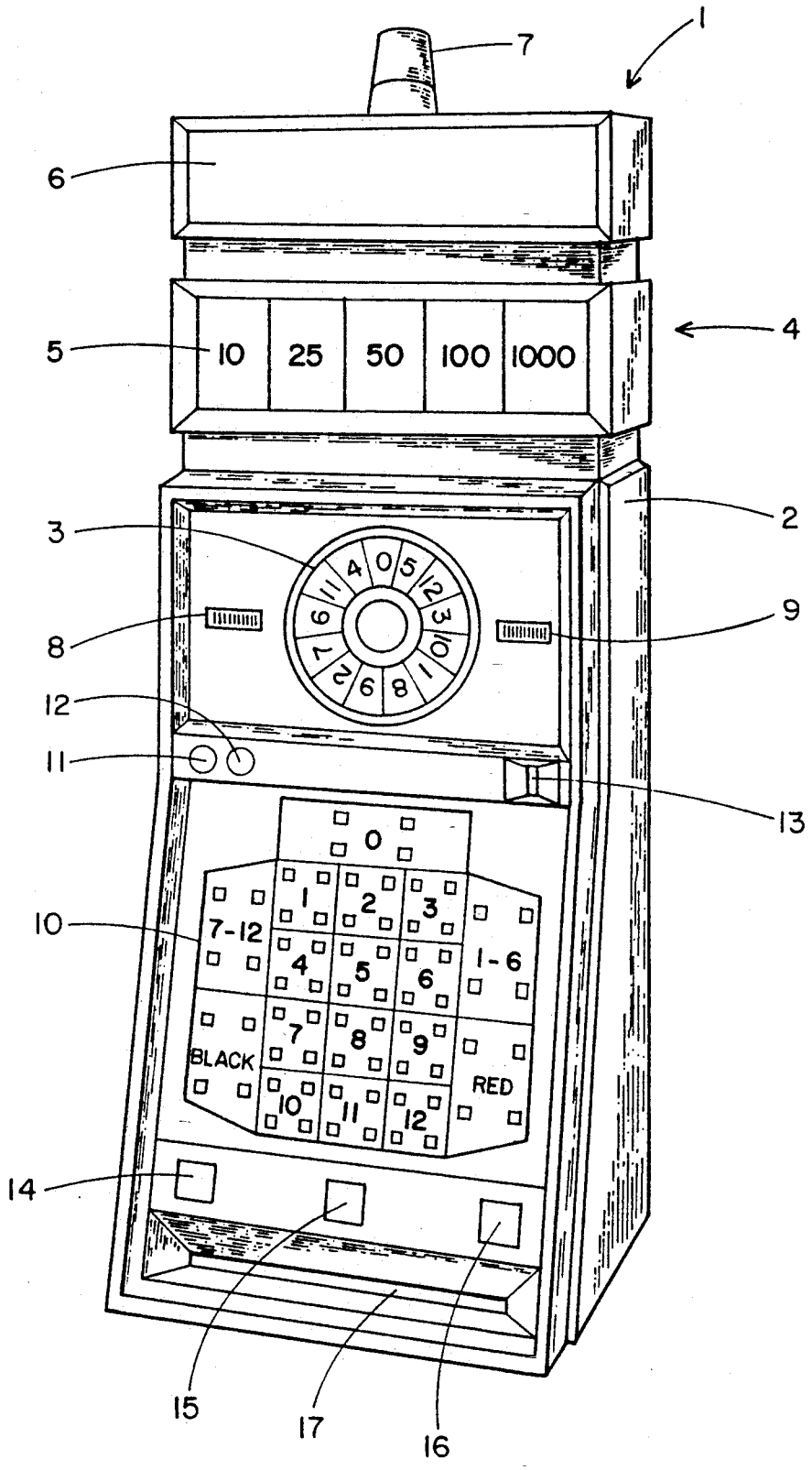
FIG. 1 shows a perspective view of a coin-operated gaming machine according to the invention which is explained in more detail below.
Figure 2:
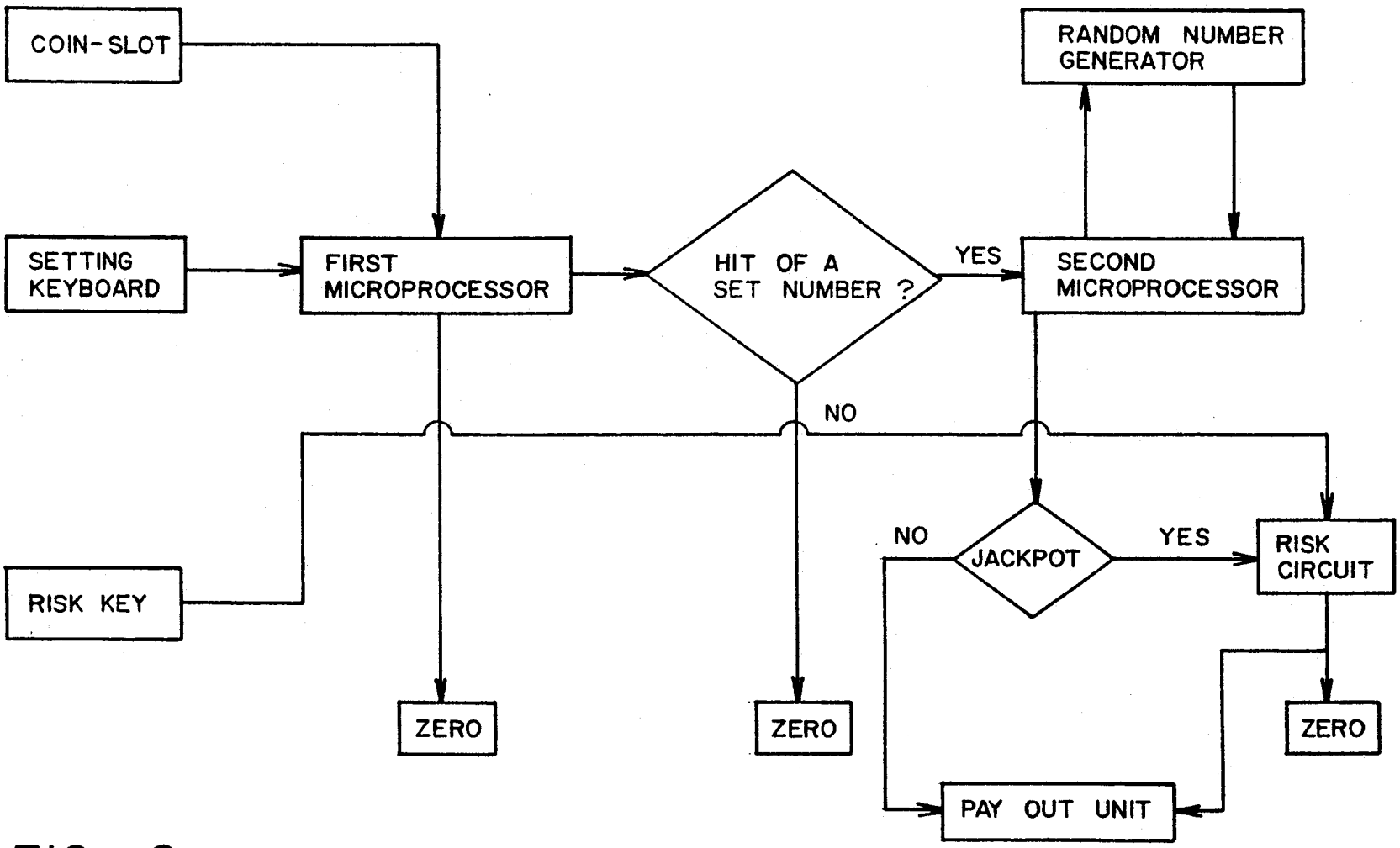
FIG. 2 shows a flow chart diagram of the coin operated game machine.

On the front side of the machine housing 2 of the coin-operated gaming machine 1 there are formed a roulette-like number pan 3 and a setting keyboard 10. Above the number pan 3 there is located a built-on part 4 with a display panel 5 for win multipliers and a display panel 6 for indicating that the coin-operated gaming machine 1 is a roulette-type gaming machine. On the top side of the built-on part 4 there is located a flash lamp 7 which flashes in the event of a fault of the coin-operated gaming machine and in the event of a jackpot. The supervisory personnel can thereby immediately recognize deviations from the normal playing mode or the occurrence of faults. The built-on part 4 can also be integrated into the actual machine housing 2. Next to the number pan 3 there is located a display panel 8 for the win display and a display panel 9 for indicating the stake still available. Between the number pan 3 and the setting keyboard 10 there are arranged function keys 11, 12 and the coin-insertion slot 13. Arranged under the setting keyboard 10 there are further function keys 14, 15, 16 and the coin-ejection tray 17.

The setting keyboard 10 has keyboards for the numbers 0 to 12 and keyboards for the high numbers 7 to 12 and for the low numbers 1 to 6 and for numbers arranged only o the black or only on the red background. The maximum stake of coins in one playing period is limited and can amount, for example, to 15 coins for each keyboard selected. If the set number is hit, a hit is obtained. In this case, the microprocessor of the control unit in the machine housing causes the activation of an additional processor having a random-number generator which determines the win multiplier on the basis of the entered algorithm. This can be organized, for example, according to a grading of 10, 25, 50, 100, 1000 or 8, 12, 20, 100, 1000. When the win multiplier 1000 is determined, a jackpot is achieved and the coin-operated gaming machine 1 ejects an amount corresponding to 1000 times the stake, in this example 15000 coins.

What is claimed is:

1. A process for operating an electronic coin-operated gaming machine of the roulette type, the gaming machine including a roulette-like number pan with number fields having a plurality of numbers displayed thereon and a setting keyboard a plurality of keys, the amount of keys being equal to the amount of numbers on the number-pan, wherein each key corresponds to a particular number on said number-pan, said keys arranged on the front side of the coin-operated gaming machine, the process comprising a player fixing the amount of a stake by inserting coins into a coin-slot of the gaming machine and subsequently said player selecting a number from said number pan by depressing the corresponding key of the setting keyboard, said depressed key activating a random algorithm in a first microprocessor, said first algorithm randomly selecting a number from said plurality of numbers;

said first microprocessor determining if said randomly selected number corresponds to the number which has been selected by the depressed key of the keyboard, if said randomly selected number corresponds to said number selected by the depressed key, said first microprocessor activating a second microprocessor with a random-number generator, said random-number generator randomly determining a win multiplier as a function of an entered algorithm and said second microprocessor multiplying said randomly selected win multiplier by the amount of the stake on the selected number and said second microprocessor activating a payout unit to output a number of coins, the quantity of which corresponds to the product of the stake on the selected number times the win multiplier.

2. A process as claimed in claim 1, wherein the first microprocessor activates a 33-bit processor as the second microprocessor.

3. A process as claimed in claim 2, wherein the second microprocessor is designed as a random-number generator.

4. A process as claimed in claim 1, wherein the signal representing the win multiplier is fed to a risk circuit which is connected with a risk key on the front side of the gaming machine which allows the player a play by risking a jackpot.

5. A process as claimed in claim 1, wherein said gaming machine further includes a risk key and a risk circuit so that, in the event that the first game result corresponds to the number which has been selected by the key of the keyboard, the jackpot status is displayed on the front face of the gaming machine and the activation of the payout unit is delayed for a short time, and wherein said process further comprises activating the risk circuit b y means of the risk key following the display of the jackpot status and prior to activation of the payout unit to output a number of coins, and subsequently selecting a key of the setting keyboard with the amount of the jackpot being the amount of the stake.

* * * * *